United States Patent [19]

Mori

[11] Patent Number: 4,729,362

[45] Date of Patent: Mar. 8, 1988

[54] FUEL INJECTION CONTROL APPARATUS FOR MULTI-CYLINDER INTERNAL COMBUSTION ENGINE

[75] Inventor: Yasushi Mori, Yokohama, Japan

[73] Assignee: Nissan Motor Company, Limited, Yokohama, Japan

[21] Appl. No.: 885,686

[22] Filed: Jul. 15, 1986

[30] Foreign Application Priority Data

Jul. 16, 1985 [JP] Japan ..... 60-157336

[51] Int. Cl.[4] ..... F02B 3/00

[52] U.S. Cl. ..... 123/492; 123/490

[58] Field of Search ..... 123/492, 490

[56] References Cited

U.S. PATENT DOCUMENTS

| | | | |
|---|---|---|---|
| 4,508,085 | 4/1985 | Yamato | 123/492 |
| 4,527,529 | 7/1985 | Suzuki | 123/492 |
| 4,573,443 | 3/1986 | Watanabe | 123/492 |

*Primary Examiner*—Ronald B. Cox

*Attorney, Agent, or Firm*—Schwartz, Jeffery, Schwaab, Mack, Blumenthal & Evans

[57] ABSTRACT

An apparatus for controlling an internal combustion engine having a plurality of cylinders and fuel injectors provided for the respective cylinders. The apparatus includes a digital computer for calculating a value for fuel delivery requirement based upon various engine operating conditions. The digital computer provides a control signal in response to a demand for engine acceleration. A control circuit is coupled between the digital computer and the fuel injectors for generating synchronous fuel injection pulses having a pulse width corresponding to the calculated value to drive the fuel injectors in synchronism with engine rotation. The control circuit generates an asynchronous fuel injection signal to drive the fuel injectors so as to provide an additional supply of fuel to the engine in response to the control signal. The control circuit includes retards the timing of generation of the synchronous fuel injection pulses successive from the asynchronous fuel injection pulse whenever the control signal occurs in a predetermined range within an interval between two synchronous fuel injection pulses.

5 Claims, 6 Drawing Figures

FUEL INJECTION CONTROL APPARATUS FOR MULTI-CYLINDER INTERNAL COMBUSTION ENGINE

BACKGROUND OF THE INVENTION

This invention relates to an apparatus for use in a multi-cylinder internal combustion engine for controlling fuel injection thereto and, more particularly, to a fuel injection control apparatus in which acceleration enrichment is provided in response to a sensed demand for engine acceleration.

During rapid throttle opening maneuvers, lean air-fuel ratio excursions in the mixture drawn into the cylinders will typically result if the fuel supply rate is not increased beyond the normal steady state running fuel requirements. This is the case where the fuel injection period is determined based mainly on the measurement of the intake air flow sensed by an airflow sensor provided to sense the air flow through the engine induction passage.

One reason for the lean air-fuel ratio excursion is that the airflow sensor has a slow response to a rapid air increase resulting from the rapid throttle opening and the signal from the airflow sensor will lag somewhat behined the actual amount of air to the intake mainfold, resulting in a lean air-fuel ratio excursion that may result in degraded engine accelerating performance and emissions.

The lean air-fuel ratio excursion resulting from the slow response of the airflow sensor may be avoided by providing an asynchronous fuel injection in response to a rapid throttle opening representing a demand for engine acceleration. However, this method cannot be applied directly to the fuel injection control apparatus in which fuel is injected in synchronism with engine crankshaft rotation into the engine intake manifold and drawn into each cylinder during its cylinder intake event since the asynchronous fuel injection is required to have a period dependent upon the cranksahft position at which the acceleration demand occurs with respect to the crankshaft position at which a synchronous fuel injection is produced in order to achieve an appropriate air-fuel ratio for all of the cylinders. For example, the asynchronous fuel injection is required to have a greater period when it is made just before or after a synchronous fuel injection than is required when the acceleration demand occurs neither just before nor just after the synchronous fuel injection. It is proposed in Japanese Patent Laid Open No. 59-51137 to determine the period of the asynchronous fuel injection in accordance with the crankshaft position at which the acceleration demand occurs with respect to the crankshaft position at which a synchronous fuel injection occurs. However, such a conventional apparatus fails to achieve an appropriate air-fuel ratio for all of the cylinders. In addition, the conventional apparatus requires a complex device capable of providing an accurate measurement of the crankshaft position at which the period of the asynchronous fuel injection is changed.

SUMMARY OF THE INVENTION

There is provided, in accordance with the present invention, an apparatus for controlling an internal combustion engine having a plurality of cylinders and fuel injectors provided for the respective cylinders. The apparatus includes signal sources for generating electrical signals indicative of engine operating conditions and means for calculating a value for fuel delivery requirement, the calculating being performed using the electrical signals. The means provides a control signal in response to a demand for engine acceleration. A control circuit is coupled between the means and the fuel injectors for generating synchronous fuel injection pulses having a pulse width corresponding to the calculate value to drive the fuel injectors in synchronism with engine rotation. The control circuit generates an asynchronous fuel injection signal to drive the fuel injectors so as to provide an additional supply of fuel to the engine in response to the control signal. The control circuit includes means for retarding the timing of generation of the synchronous fuel injection pulses successive from the asynchronous fuel injection pulse whenever the control signal occurs in a predetermined range within an interval between two synchronous fuel injection pulses.

Therefore, the present invention provides a simple fuel control apparatus capable of providing an appropriate air-fuel ratio for all of the cylinders regardless of timing of occurrence of a demand for engine acceleration.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 1:
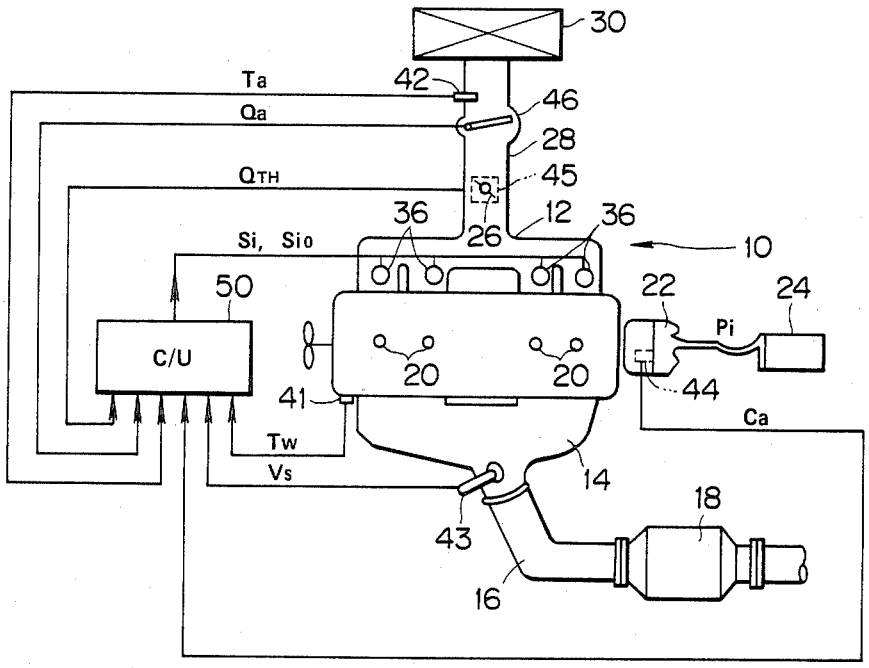
FIG. 1 is a schematic diagram showing one embodiment of a fuel injection control apparatus made in accordance with the present invention.

With reference to the drawings and in particular to FIG. 1, there is illustrated a schematic block diagram of an engine control system embodying the apparatus of the invention. An internal combustion engine, generally designated by the numeral 10, for an automotive vehicle includes a plurality, in the illustrated case four, of cylinders (not shown). While a four-cylinder, spark-ignition engine operating on a four-stroke Otto cycle is illustrated, the invention could easily applied to other types of engine. An intake manifold 12 is connected with the cylinders through respective intake ports with which intake valves are in cooperation to regulate the entry of combustion ingredients into the cylinders from the intake manifold 12, respectively. An exhaust manifold 14 is connected with the cylinders through respective exhaust ports with which exhaust valves are in cooperation to regulate the exit of combustion products, exhaust gases, from the cylinders into the exhaust manifold 14, respectively. The exhaust gases are discharged to the atmosphere through an exhaust system which includes an exhaust pipe 16 having a catalytic converter 18. The intake and exhaust valves are driven through a suitable linkage with the crankshaft.

Spark plugs 20 are mounted in the top of the respective cylinders for igniting the combustion ingredients within the respective cylinders when the spark plugs 20 are energized sequentially by high voltage electrical energy Pi supplied at appropriate intervals from a distributor 22 connected with an ignition coil 24. The distributor 22 is of the conventional type having a rotor driven at one-half the rotational velocity of the engine crankshaft.

The amount of air permitted to enter the cylinders through the intake manifold 12 is controlled by a throttle valve 26 situated within an induction passage 28. The throttle valve 26 is connected drivingly to an accelerator pedal. The degree to which the accelerator pedal is depressed controls the degree of rotation of the throttle valve 26. The greater the depression of the accelerator pedal, the greater the amount of air permitted to enter the intake manifold 12. The reference numeral 30 designates an air cleaner through which air enters the induction passage 28.

Fuel is injected into the intake manifold 12 and mixes with the air therein. For this purpose, fuel injectors 36 are mounted for injecting fuel into the intake manifold 12 near the inlet ports of the respective cylinders during the period that the fuel injectors 36 are energized by the presence of electrical current. Fuel is supplied to the injectors 36 at a constant pressure. The lenght of the fuel injection electrical pulse, that is, the pulse-width, applied to the fuel injectors 36 determines the length of time the fuel injectors open and, thus, determines the amount of fuel injected into the intake manifold 12.

The amount of fuel metered to the engine, this being determined by the pulse width of the fuel injection signal Si or Sio applied to the fuel injectors 36 and the timing of fuel injection are repetitively determined from calculations performed by a control unit, these calculations being based upon various conditions of the engine that are sensed during its operation. These sensed conditions include cylinder-head coolant temperature, ambient temperature, exhaust oxygen content, crankshaft position, throttle position, and intake air flow. Thus, a coolant temperature sensor 41, an intake air temperature sensor 42, an oxygen sensor 43, a crankshaft position sensor 44, a throttle position sensor 45, and an airflow sensor 46 are connected to the control unit 50.

The coolant temperature sensor 42 preferably is mounted in the engine cooling system and is connected in an electrical circuit capable of producing a DC voltage Tw having a variable level proportional to the coolant temperature. Similarly, the ambient temperature sensor 42 preferably is connected in an electrical circuit capable of producing a DC voltage Ta proportional to ambient temperature. A preferred location for this temperature sensor is in the engine induction passage 28 somewhere upstream of the throttle valve 26. The oxygen sensor 43 monitors the oxygen content of the exhaust and it is effective to provide a signal Vs indicative of the air/fuel ratio at which the engine is operating. The crankshaft position sensor 44 preferably is drivingly associated with the distributor's rotor and it generates a series of crankshaft position pulses Ca each corresponding to a predetermined number of degrees, in the illustrated case 180 degrees, of rotation of the engine crankshaft at a repetitive rate double the frequency of rotation of the engine. The throttle position sensor 45 includes a potentiometer which is drivingly associated with the throttle valve 26 and is connected in a voltage divider circuit for supplying a voltage signal $\theta_{TH}$ proportional to the throttle valve position. The airflow sensor 46 is responsive to the air flow through the induction passage 28 to produce a signal Qa proportional thereto.

The control unit 50 calculates a value for fuel delivery requirement in response to the sensed engine conditions. The control unit 50 in the form of a pulse signal having a pulse width corresponding to the calculated value. Additionally, the digital computer generates, from the output port 506, a pulse-width control signal and also a timing control signal, in the form of a high or logic 1 level pulse, upon occurrence of a requirement for engine acceleration.

An electrical circuit is coupled between the digital computer and the fuel injectors 36 for generating a synchronous or asynchronous fuel injection signal Si or Sio having a pulse width corresponding to the calculated value to energize or drive the fuel injectors 36. The electrical circuit includes a timing circuit which comprises a binary counter 511 having an output coupled to one input of an OR circuit 512, another input of which is connected to receive the timing control signal fed from the output port 506. The binary counter 511 is connected to receive a series of crankshaft position pulses Ca generated from the crankshaft position sensor 44 each time the crankshaft rotates at a predetermined number of degrees, in the illustrated case 180 degrees. The binary counter 511 generates a timing signal, in the form of a high or logic 1 level pulse, through the OR circuit 512 whenever it counts two crankshaft position pulses. This timing signal is applied to the reset terminal R of the binary counter 511 which thereby is reset to zero. The electrical circuit also includes a drive circuit 513 connected to receive the pulse-width control signal fed from the output port 506. The drive circuit 513 generates a synchronous or asynchronous fuel injection signal Si or Sio having a pulse width corresponding to the calculated value through an amplifier circuit 514 to drive the fuel injectors 36 in response to the timing signal fed generates a synchronous fuel injection pulse in synchronism with engine rotation to drive the fuel injectors 36 for a period corresponding to the calculated valve. In addition, the control unit 50 generates an asynchronous fuel injection pulse to drive the fuel injectors 36 in response to a demand for engine acceleration. If the demand occurs for engine acceleration in a predetermined range of engine crankshaft position within an interval between two synchronous fuel injection pulses, the control unit 50 retards the timing of generation of the subsequent synchronous fuel injection pulses.

Figure 2:
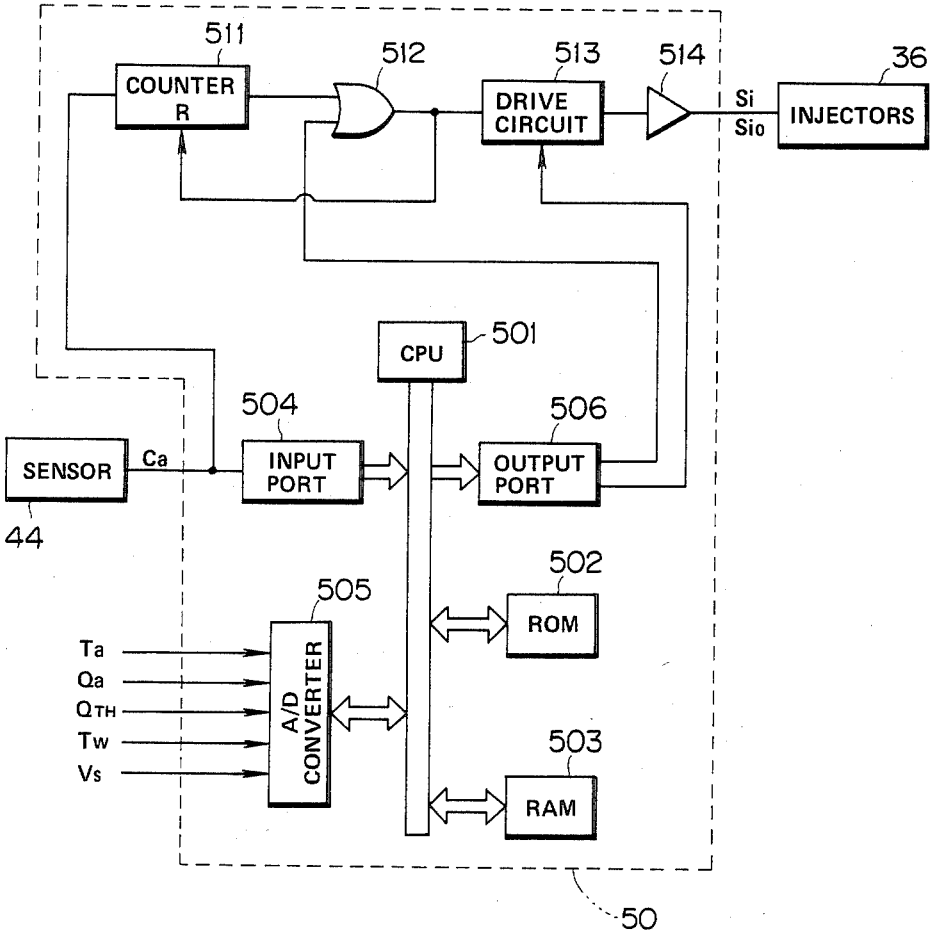
FIG. 2 is a block diagram of the control unit used in the apparatus of FIG. 1.

Referring to FIG. 2, the control unit 50 employs a digital computer which includes a central processing unit (CPU) 501 for controlling the energization of the fuel injectors by executing an operating program which is permanently stored in a read only memory (ROM) 502. The digital computer also includes a random access memory (RAM) 503 into which data may be temporarily stored and from which data may be read at address locations determined in accordance with the computer program stored in the ROM 502. The pulse output Ca is coupled from the crankshaft position sensor 44 to an input port 504 and is used to establish the timing of fuel injection. The analog signals from the ambient temperature sensor 42, the airflow sensor 46, the throttle position sensor 45, the coolant temperature sensor 41, and the oxygen sensor 43 are coupled to an analog-to-digital converter 505 which converts them, one by one, into corresponding digital signals for application to the central processing unit 501. The digital computer central processing unit 501 repetitively calculates a value for fuel delivery requirement using the sensed engine operating conditions. The digital computer generates, from an output port 506, a pulse-width control signal, thereto from the OR circuit 512.

Normally, the fuel injection pulses supplied to drive the fuel injectors 36 are issued at intervals of a predetermined number of degrees, in the illustrated case 360 degrees, of rotation of the engine crankshaft to initiate synchronous fuel injection. While the digital computer determines a demand for engine acceleration when the rate of change in the throttle valve position exceeds a predetermined value, it generates a timing control signal to initiate asynchronous fuel injection for acceleration enrichment. The timing signal causes a timing circuit to retard the timing of generation of the subsequent synchronous fuel injection pulses only when the acceleration demand occurs in the subsequent half portion of the interval between two synchronous fuel injection pulses.

Figure 3:
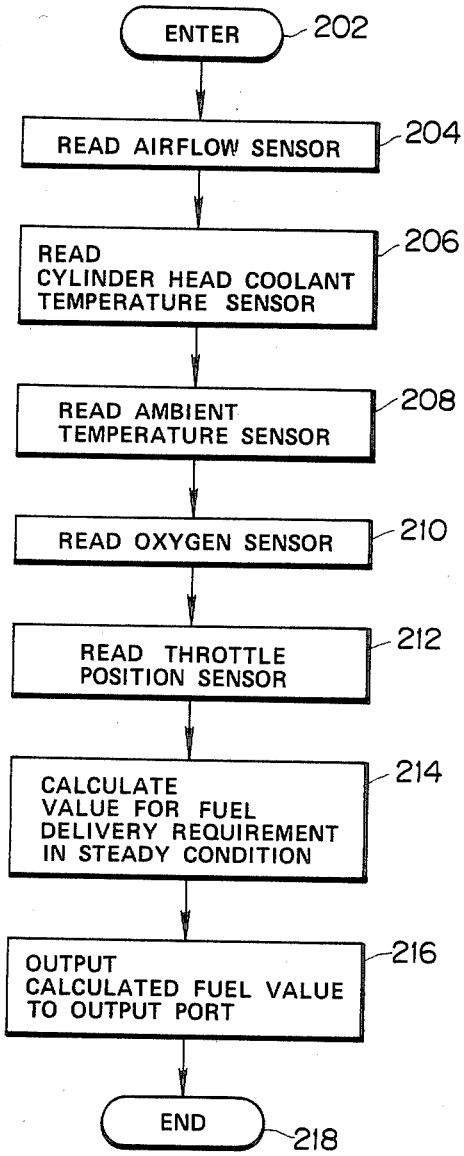
FIG. 3 is a flow diagram of the programming of the digital computer as it is used to control fuel injection during normal engine conditions.

FIG. 3 is a flow diagram of the programming of the digital computer as it is used to control fuel delivery requirements during normal engine conditions. The computer program is entered at the point 202. Following this, the various inputs are, one by one, converted by the analog-to-digital converter 505 into digital form and read into the computer memory 503. Thus, at the point 204 in the program, the intake air flow signal Qa is converted to digital form and read into the computer memory 503. Similarly, at the point 206, the coolant temperature signal Tw is converted to digital form and read into the computer memory 506, as is the ambient temperature signal Ta at point 208. At the point 210, the oxygen content signal Vs is converted to digital form and read into the computer memory. Likewise, the throttle position signal $\theta_{TH}$ is converted to digital form and read into the computer memory at the point 212.

At the point 214, the fuel-delivery requirement, in the form of fuel-injection pulse-width, is calculated by the digital computer central processing unit 501 from a relationship programmed into the computer. This relationship defines fuel-injection pulse-width as a function of intake air flow, ambient temperature, cylinder-head coolant temperature, and exhaust oxygen content in such a manner as well known in the art.

At the point 216, the calculated value for fuel-injection pulse-width is transferred to the output port 506. The output port 506 then sets the fuel injection pulse-width according to the calculated value for it on the drive circuit 513. Each time the binary counter 511 counts two crankshaft position pulses Ca each corresponding to a predetermined number of degrees, in the illustrated case 180 degrees, of rotation of the engine crankshaft, it generates a timing pulse through the OR circuit 512 to trigger the drive circuit 513 which thereby generates a synchronous fuel injection pulse Si having a pulse width set thereon, as indicated by the characters To and T1 in FIGS. 5 and 6. The timing pulse is also applied to reset the binary counter 511 to zero. The synchronous fuel injection pulse is applied through the amplifier circuit 514 to energize the fuel injectors 36 for a length of time corresponding to the pulse-width of the fuel injection pulse Si. It is to be noted that the synchronous injection pulse Si is generated at intervals corresponding to a predetermined number of degrees, in the illustrated case 360 degrees, of rotation of the engine crankshaft during normal engine conditions. Following this, the program proceeds to the end point 218.

Figure 4:
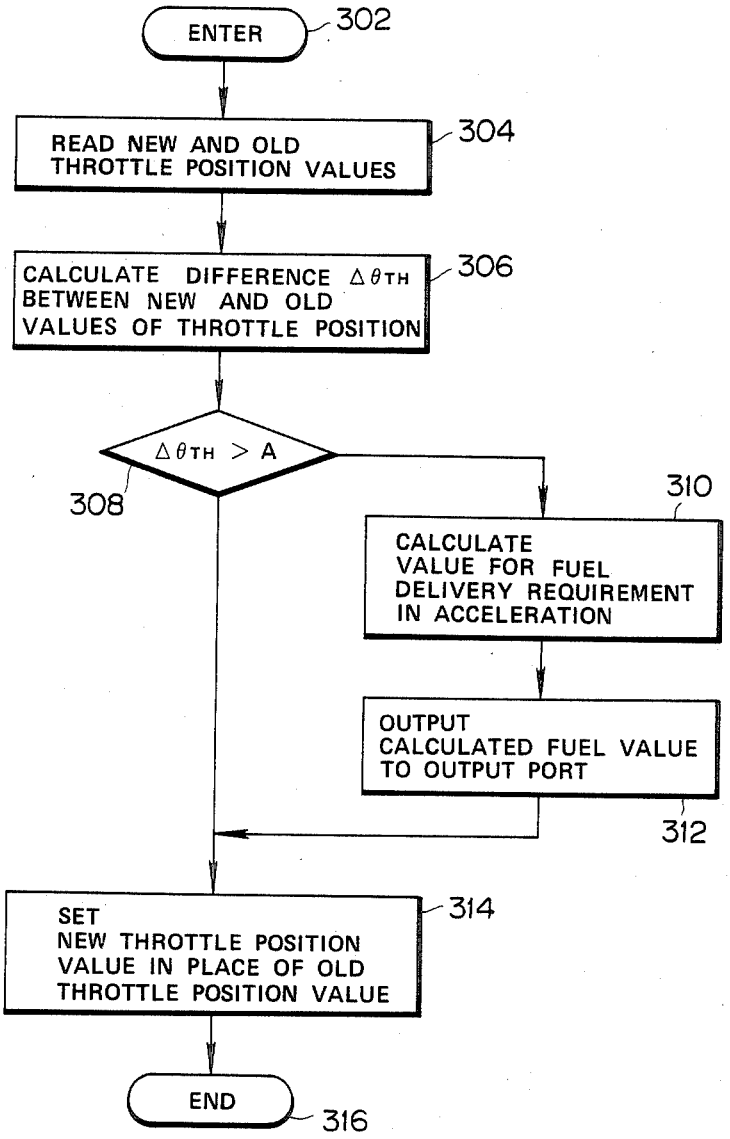
FIG. 4 is a flow diagram of the programming of the digital computer as it is used to control fuel injection during acceleration.

FIG. 4 is a flow diagram of the programming of the digital computer as it is used to control fuel delivery requirements during acceleration. The computer program is entered at the point 302 at constant time intervals. At the point 304 in the program, the new and old values $\theta_{TH}$, $\theta_{THOLD}$ of throttle position are read out of the computer memory 503. At the point 306, the digital computer central processing unit 501 calculates a difference ($\Delta\theta_{TH}$) of the old throttle position value $\theta_{THOLD}$ from the new throttle position value $\theta_{TH}$. At the point 308, a determination is made as to whether or not the calculated difference $\Delta\theta_{TH}$ is greater than a predetermined value A. If the answer to this question is "yes", then it means that the engine is in acceleration and the program proceeds to the point 310. At the point 310, the fuel delivery requirement, in the form or asynchronous fuel-injection pulse-width and fuel-injection timing, is calculated by the digital computer central processing unit 501 from a relationship programmed into the computer. This relationship defines fuel-injection pulse-width in such a manner as described later in greater detail. For example, this calculation may be made using fuel delivery requirement data obtained previously before and after a demand occurs for engine acceleration.

At the point 312, the calculated value for asynchronous fuel-injection pulse-width is transferred to the output port 506. The output port 506 then sets the asynchronous fuel injection pulse-width according to the calculated value for it on the drive circuit 513 and also generates a timing pulse through the OR circuit 512. This timing pulse is applied to reset the binary counter 511 and also to trigger the drive circuit 513 which thereby generates an asynchronous fuel injection pulse Sio having a pulse width corresponding to the value set thereon, as indicated by character X in FIGS. 5 and 6. The asynchronous fuel injection pulse Sio is applied through the amplifier circuit 514 to energize the fuel injectors 36 for a length of time corresponding to the pulse-width of the asynchronous fuel injection pulse Sio. It is to be noted that the asynchronous fuel injection pulse Sio is generated to provide an additional supply of fuel to the engine whenever a demand occurs for engine acceleration. Since the binary counter 515 is reset to zero by the timing signal generated from the output port 506 when the digital computer central processing unit 501 determines a demand for engine acceleration, the timing of generation of the subsequent synchronous fuel injection pulses is retarded by an extent corresponding to an interval between two crankshaft position pulses Ca, that is, a predetermined number of degrees, in the illustrated case 180 degrees of rotation of the engine crankshaft whenever the acceleration demand occurs in the subsequent half portion of the synchronous fuel injection interval. Following this, the program proceeds to the point 314 where the new throttle position value $\theta_{TH}$ is stored in the computer memory in place of the old throttle position value $\theta_{THOLD}$. Following this, the program proceeds to the end point 316.

If the answer to the question inputted at the point 308 is "no", then it means that the engine is not in acceleration and the program proceeds directly to the point 314.

The operation of the fuel injection control apparatus of the present invention will be described further with reference to FIGS. 5 and 6 each containing three waveforms (a) to (c) and one diagram (d) drawn on the same time scale. Waveform (a) relates to crankshaft position pulses Ca which are generated at intervals of 180 degrees of rotation of the engine crankshaft. Waveform (b) relates to the count accumulated on the binary counter 511. Waveform (c) relates to the timing of generation of fuel injection pulses. When the binary counter 511 counts two crankshaft position pulses Ca, its output changes to a high or logic 1 level to cause generation of a synchronous fuel injection pulse Si and also to reset the binary counter 511 to zero. Consequently, the synchronous fuel injection pulses are generated to initiate synchronous fuel injection at intervals of 360 degrees of rotation of the engine crankshaft. The characters To and T1 indicate synchronous fuel injection pulses generated before a demand occurs for engine acceleration and the characters T2 and T3 indicate synchronous fuel injection pulses generated after the acceleration demand occurs. Diagram (d) shows the order of the intake strokes of the pistons for the respective four cylinders, where the character X indicates the timing of firing.

Figure 5:
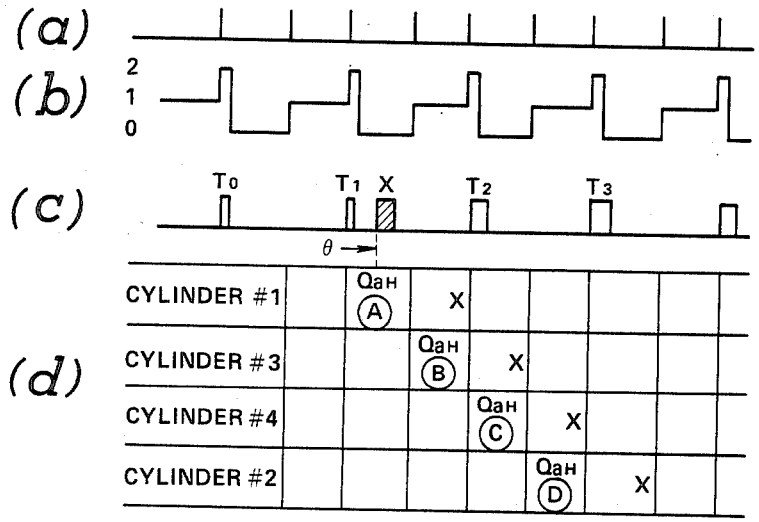
FIGS. 5 and 6 are diagrams used in explaining the operation of the fuel injection control apparatus of the invention.

If a demand occurs for engine acceleration at a crankshaft position $\theta$ contained in the early half portion of the synchronous fuel injection interval, that is, the interval between two synchronous fuel injection pulses, as shown in FIG. 5, the digital computer generates a timing control signal, causing generation of an asynchronous fuel injection pulse, indicated by the character X, to drive the fuel injectors 36 so as to provide an additional supply of fuel to the engine. In this case, the binary counter 511 accumulates no count and thus the timing control signal from the digital computer has no effect on the operation of the binary counter 511. As a result, the timing of generation of the subsequent synchronous fuel injection pulses is unchanged, as can be seen from FIG. 5.

Figure 6:
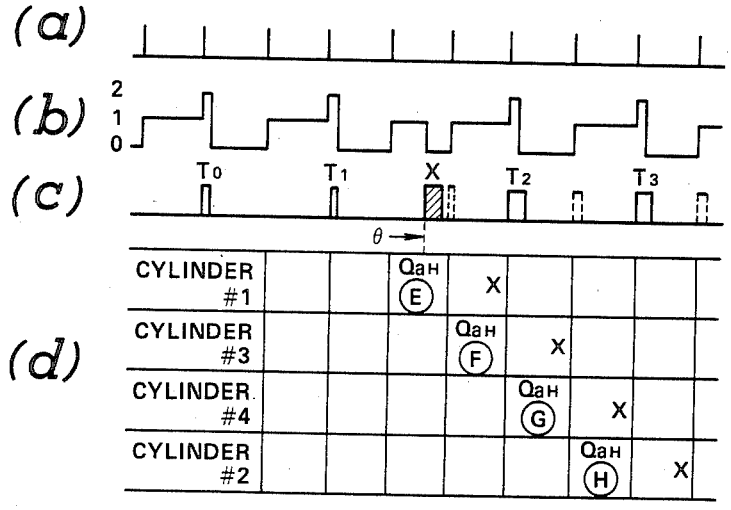

If a demand occurs for engine acceleration at a crankshaft position $\theta$ contained in the subsequent half portion of the synchronous fuel injection interval, as shown in FIG. 6, the digital computer generates a timing control signal, causing generation of an asynchronous fuel injection pulse, indicated by the character X, to drive the fuel injectors 36 so as to provide an additional supply of fuel to the engine. In this case, the timing control signal from the digital computer resets the binary counter 511 which has already counted one crankshaft position pulse Ca. As a result, the timing of generation of the subsequent synchronous fuel injection pulses is retarded by an extent corresponding to the interval between two crankshaft position pulses, that is, 180 degrees of rotation of the engine crankshaft, as can be seen from FIG. 6.

Table 1 shows the amounts of fuel sucked into the respective cylinders during their intake events (A) to (D) in the case where a demand occurs for engine acceleration at an crankshaft position contained in the eary half portion of the synchronous fuel injection interval. Table 2 shows the amounts of fuel sucked into the respective cylinders during their intake events (E) to (H) in the case where a demand occurs for engine acceleration at a crankshaft position contained in the subsequent half portion of the synchronous fuel injection interval. In either case, each cylinder sucks fuel injected during the interval, at which its intake stroke occurs, of 720 degrees of rotation of the engine crankshaft.

TABLE 1

| INTAKE EVENT | INTAKE FUEL AMOUNT | DEVIATION FROM OPTIMUM AMOUNT |
|---|---|---|
| A | To + T1 + X = 2qL + X | X − 2 (qH − qL) |
| B | To + T1 + X = 2qL + X | X − 2 (qH − qL) |
| C | T1 + X + T2 = qH + qL + X | X − (qH − qL) |
| D | T1 + X + T2 = qH + qL + X | X − (qH − qL) |

TABLE 2

| INTAKE EVENT | INTAKE FUEL AMOUNT | DEVIATION FROM OPTIMUM AMOUNT |
|---|---|---|
| E | To + T1 + X = 2qL + X | X − 2 (qH − qL) |
| F | To + X = qL + X | X − (2qH − qL) |
| G | T1 + X + T2 = qH + qL + X | X − (qH − qL) |
| H | X + T2 = qH + X | X − qH |

In these tables, the characters T0 and T1 indicate the pulse widths of the last two synchronous fuel injection pulses T0 and T1 produced before a demand occurs for engine acceleration, the character T2 indicates the pulse width of the first synchronous fuel injection pulse produced after the acceleration demand occurs, and the characters qL and qH indicate the amounts of fuel injected to each cylinder before and after the acceleration demand occurs, respectively. Since the optimum amount of fuel to be injected into each cylinder is 2qH after occurrence of the acceleration demand, the deviations are represented as $2qL+X-2qH=X-2(qH-qL)$ for the cylinder #1 during its intake phase A, as $2qL+X-2qH=X-2(qH-qL)$ for the cylinder #3 during its intake phase B, as $qH+qL+X-2qH=X-(qH-qL)$ for the cylinder #4 during its intake phase C, as $qH+qL+X-2qH=X-(qH-qL)$ for the cylinder #2 during its intake phase D, as $2qL+X-2qH=X-2(qH-qL)$ for the cylinder #1 during its intake phase E, as $qL+X-2qH=X-(2qH-qL)$ for the cylinder #3 during its intake phase F, as $qH+qL+X-2qH=X-(qH-qL)$ for the cylinder #4 during its intake phase G, and as $qH+X-2qH=X-qH$ for the cylinder #2 during its intake phase H.

The difference of the minimum intake fuel amount from the maximum intake fuel amount is calculated as $(qH+qL+X)-(2qL+X)=qH-qL=qH$ in Table 1 and as $(qH+qL+X)-(qL+X)=qH$ in Table 2. In addition, the fuel shortages without the fuel injection pulse X can be expressed as 2(qH−qL), 2qH−qL, qH−qL, and qH, where (2qH−qL)>2(qH−qL)>qH>(qH−qL). If the pulse width of the fuel injection pulse X corresponds to 2qH−qL, the air-fuel ratio is correct in the cylinder #1 during its intake phase E, somewhat rich in the cylinder #1 during its intake phase A, in the cylinder #3 during its intake phase B and in the cylinder #3 during its intake phase F, rich to some extent in the cylinder #2 during its intake phase H, and rich to some extent in the cylinder #4 during its intake phase G and in the cylinder #4 during its intake phase C. It is, therefore, apparent that there is no cylinder in which the air-fuel ratio is excessively rich or lean in fuel in either of the cases described in connection with FIGS. 5 and 6.

Although the invention has been described in detail in connection with a four-cylinder engine, the particular engine shown is only for illustrative purposes and the structure of this invention could be readily applied to any engine structure. The counter 511 may be arranged to couts a predetermined number of engine crankshaft position pulses to accumulate a count predetermined in accordance with the number of the cylinders of the engine before it is reset in response to a signal from the OR circuit 512. For example, for a six cylinder engine, the counter 511 may be replaced with a counter which counts three crankshaft position pulses before it is reset in response to a signal from the OR circuit 512. With such an arrangement, the control circuit retards the timing of generation of the synchronous fuel injection pulses successive from an asynchronous fuel injection pulse to an extent corresponding to a first interval between adjacent two crankshaft pulses whenever the control signal occurs to cause an asynchronous fuel injection when the count of the counter is 1 and retards the timing of generation of the synchronous fuel injection pulses successive from the asynchronous fuel injection pulse to an extent corresponding to an interval double the first interval whenever the control signal occurs when the count of the counter is 2.

While this invention has been described in conjunction with a specific embodiment thereof, it is evident that many alternatives, modifications and variations will be apparent to those skilled in the art. Accordingly, it is intended to embrace all alternatives, modifications and variations that fall within the scope of the appended claims.

What is claimed is:

1. An apparatus for controlling an internal combustion engine having a plurality of cylinders, a crankshaft, and fuel injectors provided for the respective cylinders, comprising:

signal sources for generating electrical signals indicative of engine operating conditions;

means for calculating a value for fuel delivery requirement, said calculating being performed using said electrical signals, said means being responsive to a demand for engine acceleration for providing a control signal; and a control circuit coupled between said means and said fuel injectors for generating synchronous fuel injection pulses having a pulse width corresponding to said calculated value to drive said fuel injectors in synchronism with engine rotation, said control circuit being responsive to the control signal for generating an asynchronous fuel injection pulse to drive said fuel injectors, said control circuit retarding the timing of generation of the synchronous fuel injection pulses successive from the asynchronous fuel injection pulse whenever said control signal occurs in a predetermined range within an interval between two synchronous fuel injection pulses.

2. The apparatus as claimed in claim 1, wherein said control circuit includes means for retarding the timing of generation of the synchronous fuel injection pulses successive from the asynchronous fuel injection pulse by an extent corresponding to one-half of the interval between two synchronous fuel injection pulses whenever said control signal occurs in the subsequent half portion of the interval between two synchronous fuel injection pulses.

3. The apparatus as claimed in claim 1, wherein said signal sources include a source for generating a crankshaft position pulse each time said crankshaft rotates at a predetermined number of degrees, and wherein said control circuit includes timing circuit for generating a timing signal each time a predetermined number of crankshaft position pulses occur, said timing circuit being responsive to said control signal for providing a timing signal, said timing circuit retarding the timing of generation of the synchronous fuel injection pulses by an extent corresponding to an interval during which a predetermined number of crankshaft position pulses occur whenever said control signal occurs in the predetermined range, said control circuit including a drive circuit for converting said calculated value into a corresponding fuel injection pulse width, said drive circuit being responsive to the timing signal for generating the fuel injection pulse to drive said fuel injectors.

4. The apparatus as claimed in claim 3, wherein said engine has four cylinders, and wherein said timing circuit including means for generating a timing signal each time two crankshaft position pulses occur, said timing circuit including means for retarding the timing of generation of the synchronous fuel injection pulses by an extent corresponding to an interval between adjacent two crankshaft position pulses.

5. The apparatus as claimed in claim 4, wherein said timing circuit includes a counter for generating a counter output signal each time said counter counts two of said crankshaft position pulses, and means responsive to the counter output signal or said control signal for providing the timing signal, said counter being reset to zero in response to said timing signal.

* * * * *